US011653739B1

(12) United States Patent
Zheng et al.

(10) Patent No.: US 11,653,739 B1
(45) Date of Patent: May 23, 2023

(54) APPLICATOR HEAD FOR A FLUID PRODUCT

(71) Applicant: APR Beauty Group Inc, Toronto (CA)

(72) Inventors: Min-Yan Zheng, Ontario (CA); Feng-Ying Fu, Markham (CA); Jun Shen, Lighthouse Point, FL (US)

(73) Assignee: APR Beauty Group, Inc., Toronto (CA)

( * ) Notice: Subject to any disclaimer, the term of this patent is extended or adjusted under 35 U.S.C. 154(b) by 0 days.

(21) Appl. No.: 17/589,781

(22) Filed: Jan. 31, 2022

(51) Int. Cl.
*A45D 34/04* (2006.01)
*A45D 34/00* (2006.01)
*A45D 40/26* (2006.01)

(52) U.S. Cl.
CPC ..... *A45D 34/04* (2013.01); *A45D 40/26* (2013.01); *A45D 2034/002* (2013.01); *A45D 2200/055* (2013.01); *A45D 2200/1009* (2013.01); *A45D 2200/15* (2013.01); *A45D 2200/155* (2013.01)

(58) Field of Classification Search
CPC ..... A45D 34/04; A45D 200/055; A45D 2200/155; A45D 2200/1009; A45D 40/26; A45D 2034/002; A45D 2040/0006; A45D 2033/001; A45D 2200/00; A45D 2200/10; A45D 2200/15; A45D 200/20; A45D 2200/205; A45D 2200/152
USPC ..... 401/261–266
See application file for complete search history.

(56) References Cited

U.S. PATENT DOCUMENTS

| | | | | |
|---|---|---|---|---|
| 8,292,535 | B2 | 10/2012 | Thorpe | |
| 8,573,874 | B2 | 11/2013 | Neuner | |
| 9,498,042 | B2 * | 11/2016 | Villarreal | A45D 34/04 |
| 2015/0023721 | A1 * | 1/2015 | Gieux | A45D 34/04 401/265 |
| 2017/0055672 | A1 * | 3/2017 | Duquet | A45D 34/00 |
| 2020/0305574 | A1 * | 10/2020 | Perez | B05B 1/06 |

* cited by examiner

*Primary Examiner* — David J Walczak
(74) *Attorney, Agent, or Firm* — Jason Lee DeFrancesco

(57) ABSTRACT

An applicator head intended to be associated with a cosmetic dispensing package for dispensing and applying a fluid product. The applicator head includes a first applicator member and a second applicator member coupled to one side of the first applicator member. The second applicator member made of a material capable of holding and retaining a thermal charge. An upper surface of the applicator head defines an applicator surface adapted to apply and dispense the fluid product. The applicator surface is angled with respect to a longitudinal axis of the applicator head. A recessed concavity is formed on the applicator surface and a discharge opening is disposed within the recessed concavity. A first portion of the recessed concavity lies on the first applicator member and a second portion of the recessed concavity lies on the second applicator member.

20 Claims, 7 Drawing Sheets

APPLICATOR HEAD FOR A FLUID PRODUCT

BACKGROUND

Field

The present disclosure relates to an applicator head for a fluid product, such as a cosmetic product or medicinal product, and intended to be associated with a cosmetic dispensing package, such as a pump, a valve, or a flexible tube. The applicator head is at least partially made of a thermal material which offers a thermal effect to create a cold sensation upon application.

Description of the Related Art

There are packages for the distribution of cosmetic and medicinal products. Such packages usually consist of an outer shell or tubular casing, a dispensing mechanism for moving cosmetic or medicinal products, and an applicator tip. For example, in the medical industry, applicators are used to apply medicinal products such as ointments to different parts of the body. In the cosmetics and personal care industry, applicators are used to apply lipstick, lip balm, skin creams, lotions and other cosmetic products to parts of the body.

In many cases, these medicinal and cosmetic products may include skincare substances such as aloe vera or lanolin, which provide a healing or therapeutic effect to heal damaged skin or maintain healthy skin. In addition, these products may include therapeutic substances such as local anesthetics, painkillers, fragrances, menthol, or other substances that provide a supple or stimulating sensation when applied to the skin of a skin user. In addition to skincare substances, heat treatments (for example the application of heat and/or cold) are known to relieve pain, to provide a therapeutic sensation, and to slow down the body's natural response to injury resulting in a slower and more controlled healing process.

In the fields of cosmetics and pharmacy, cosmetic dispensing package already exist comprising a fluid reservoir associated with a rigid and heat-transfer dispenser head for putting into contact with the skin, in particular the skin of the face. Documents US U.S. Pat. No. 8,573,874B2, and U.S. Pat. No. 8,292,535B2 are known, for example. The head forms an applicator pad from which a dispenser opening opens out. The user actuates the dispenser so as to dispense a dose of fluid, and then spreads it by means of the applicator pad which provides a massaging effect and above all a cold sensation on contact with the skin which is very pleasant.

In document U.S. Pat. No. 8,292,535B2, the pad that is made of metal or ceramic defines a borehole in which a plastics insert is received that forms an outlet duct and the dispenser opening. As a result, the fluid that is dispensed is never in contact with the borehole, but the opening is visibly formed by a part (the insert) that is distinct from the pad, which is not particularly attractive.

In document U.S. Pat. No. 8,573,874B2, the pad includes a frustoconical dispenser passage defining, on its inner face, a very wide inlet, and on its outer face, a dispenser opening. The fluid that is dispensed comes into contact with the entire frustoconical passage and cools on contact therewith. It can also be said that the fluid heats the pad as a result of extended contact.

Still, there is a need for an applicator head that is capable of providing a thermal treatment to user's skin and is economical to manufacture, and aesthetically pleasing.

SUMMARY

It is an object of the present disclosure to provide an applicator head intended to be associated with a cosmetic dispensing package, such as a pump, a valve or a flexible tube.

It is an object of the present disclosure to provide an applicator head at least partially made of a material with thermal capacity, which is capable of retaining and transferring thermal energy.

It is an object of the present disclosure to provide an applicator head allowing a fluid product to be applied locally or topically to a selected area of a keratin surface and providing a thermal sensation to the keratin surface.

It is an object of the present disclosure to provide an applicator head which offers a comparatively large surface area, very simple to use, economical to manufacture, and aesthetically pleasing. Further, an applicator head is desired which is comfortable and easier to use.

Accordingly, there is provided an applicator head that comprises a first applicator member and a second applicator member made of a thermal material coupled to the first applicator member. An applicator surface of the applicator head is partially defined by the first applicator member and partially by the second applicator member. The applicator surface is convex and includes a recessed concavity that is partially made of the first applicator member and partially made of the second applicator member. A product delivery passageway extends through the first applicator member and terminates at a discharge opening in the recessed concavity. The recessed concavity forms a receptacle to collect a fluid product dispensed out from the discharge opening.

According to an embodiment of the present disclosure, there is provided a cosmetic dispensing package comprising a housing, the applicator head coupled to one end of the housing, and a cap configured to be coupled to the housing when the cosmetic dispensing package is not in use. This cosmetic dispensing package extends longitudinally along a longitudinal axis.

According to an embodiment of the present disclosure, a longitudinal axis of the applicator head coincides with the longitudinal axis of the cosmetic package. However, in alternate embodiments, the longitudinal axis of the applicator head may not coincide with the central longitudinal axis of the cosmetic package.

In the present implementation, the housing is configured to receive an inner container having a reservoir for containing a fluid product including a cosmetic, care, or pharmaceutical product. The cosmetic, care, or pharmaceutical product includes viscous cosmetics, mascara, eyebrow powder, lip gloss, hair color, cheek blush, skincare, under-eye cosmetics, pharmaceutical, and like products.

According to an embodiment of the present disclosure, the applicator head includes the first applicator member and the second applicator member coupled to one side of the first applicator member. The applicator head includes the applicator surface defined by an upper surface of the applicator head. The applicator surface is adapted to apply and dispense the fluid product. More particularly, the applicator surface of the applicator head is defined by an upper surface of the first applicator member together with an upper surface of the second applicator member.

Further, the product delivery passageway extends through the body of the first applicator member, terminating at a discharge opening in the applicator surface through which a fluid product is dispensed.

According to an aspect of the present disclosure, the second applicator member is made of a material different from the material of the first applicator member. The second applicator member is made of a thermal material with high thermal effusivity compared to that of the user's surface to be treated. The thermal effusivity of the second applicator member is higher than that of the first applicator member. More particularly, the second applicator member is made of a material capable of holding and retaining a thermal charge. In one implementation, the second applicator member can be made of stainless steel. However, in other implementations, any suitable material may be used that is capable of retaining heat or cold during the application of the fluid product. Examples of other suitable materials include, without limitation, metals (e.g., aluminum, titanium, steel, nickel, tin, copper, brass, alloys thereof, etc.), ceramics, high-density plastics, composites, or the like.

The first applicator member may be made of a thermoplastic polymer, for example, which is non-reactive with the fluid product stored in the housing. In other implementations, the first applicator member may be made of virtually any other material that is non-reactive or resistant to the fluid product being dispensed, such as various metals, plastics, ceramics, composites, or the like. Preferably, the first applicator member may be made of polyethylene, polypropylene, ABS, silicon, or any other suitable material. PVC, PU, EVA, SIS-SEB, nitrile, silicone, EPDM, Hytrel®, Pebax®, Santoprene®, or other thermoplastics, elastomers, this list not being limiting. According to an embodiment of the present disclosure, at least a part and preferably the complete first applicator member can be made by molding, e.g. by injection molding.

According to an aspect of the present disclosure, the applicator surface is convex (in a longitudinal direction) and angled. The applicator surface is curvilinear or curving in an ever-changing slope to allow for easy spreading of the fluid product on the skin of a user. Further, the changeable radius curvature or continuously changing angle of the sloped applicator surface facilitates even distribution and easy application of the fluid product. In the present embodiment, a peripheral edge of the applicator surface of the applicator head is rounded for comfort during the application. In alternate embodiments, the peripheral edge of the applicator surface may not be rounded.

According to another aspect of the present disclosure, the discharge opening is located within a recessed concavity formed on the applicator surface. The recessed concavity creates a suitable surface or a receptacle to collect the fluid product dispensed out from the discharge opening. Further, the recessed concavity is an indentation into the applicator surface with the discharge opening formed therein.

According to yet another aspect of the present disclosure, the applicator surface and the recessed concavity both are angled with respect to the longitudinal axis of the applicator head. The applicator surface has a longitudinal axis that is inclined relative to the longitudinal axis of the applicator head, in particular by an angle β between 15° and 75°, and preferably between 55-70°. This design facilitates the application of the applicator surface to the user's skin.

According to yet another aspect of the present disclosure, the recessed concavity has a sufficient depth so that excess fluid product can be held therein. The recessed concavity extends over more than a quarter of the width of the applicator surface as well as over more than a quarter of its length. This dimension is suitable for storing a makeup product. The recessed concavity is farther from a proximal end of the applicator surface and is close to a distal end of the applicator surface. The recessed concavity has a maximum depth of dimension such that is easier to empty the recessed concavity on contact with the skin. The maximum depth of the recessed concavity, measured along a median longitudinal plane containing the longitudinal axis of the applicator head, is less than equal to 1 mm and between 0.5 mm to 1 mm.

According to yet another aspect of the present disclosure, the dimensions of the recessed concavity can be chosen as a function of the quantity of product which it is desired to have optionally retained. Preferably, the dimensions of the recessed concavity and of the applicator surface are the following, when the recessed concavity is viewed in a top view, the maximum width of the recessed concavity, measured perpendicular to the longitudinal axis of the applicator surface, is between 2 mm and 7 mm, and preferably between 3 mm and 6 mm, the maximum length of the recessed concavity, measured along the longitudinal axis of the applicator surface is between 6 mm and 10 mm, and preferably between 6 mm and 8 mm, the maximum width of the applicator surface, measured perpendicular to the longitudinal axis of the applicator surface, is between 5 mm and 15 mm, and preferably between 8 mm and 12 mm, the length of the applicator surface, measured along the longitudinal axis of the applicator surface, is between 10 mm and 18 mm, and preferably between 11 mm and 15 mm.

According to yet another aspect of the present disclosure, the applicator head has a generally elongated shape symmetrical with respect to a median longitudinal plane containing the longitudinal axes of the applicator head and the applicator surface. The recessed concavity on the applicator surface is elongated along a longitudinal axis of the applicator surface and has shape, for example, oval, elliptical, or oblong. The recessed concavity is bordered by a peripheral surface whose width may vary from, 0.6 mm to 0.2 mm. According to a preferred embodiment, the applicator surface has an elliptical shape.

According to yet another aspect of the present disclosure, the second applicator member is coupled to one side of the first applicator member to define the applicator head such that an outer surface of the first applicator member and an outer surface of the second applicator member meet at an interface. The first applicator member and a second applicator member are aligned such that the applicator head is substantially smooth and continuous across an interface. Further, in the embodiment under consideration, the upper surface of the first applicator member and the upper surface of the second applicator member meet at the interface defined on the applicator surface.

Further, a first portion of the recessed concavity is formed on the first applicator member and a second portion of the recessed concavity is formed on the second applicator member such that when the first applicator member and the second applicator member are coupled the first and second portions of the recessed concavity align to complete the recessed concavity. At least a portion of the interface of the first applicator member and the second applicator member lies in the recessed concavity on the applicator surface.

Furthermore, the discharge opening of the applicator head is positioned in the first portion of the recessed concavity of the first applicator member and is spaced away from the interface located in the recessed concavity.

According to yet another aspect of the present disclosure, the recessed concavity has a maximum depth defined at the interface. Therefore, when the product is dispensed out from the discharge opening the fluid product starts gravitating towards the interface before filling up the recessed concavity. The fluid product gets cooled in the recessed concavity by the second portion of the recessed concavity that is made of the thermal material of the second applicator member.

Furthermore, at least 60% of the applicator surface is constituted by the upper surface of the second applicator member and at least 20% of the applicator surface is constituted by the upper surface of the first applicator member. The large upper surface of the second applicator member provides a thermal sensation to the user's skin and allows the users to massage a larger area of the keratinous surface.

When the fluid product is applied, the user can bring the fluid product contained in the recessed concavity into contact with the skin. The applicator surface is used for applying the dispensed fluid product and as well as providing thermal sensation to the user's skin. The second applicator member allows the users to massage a larger area of the keratinous surface.

In a preferred embodiment, the applicator surface is elliptical. In alternate embodiments, however, the applicator surface may have any other suitable shape and size, surface finish desired for a given application.

According to a preferred embodiment, the first applicator member comprises a lower portion that is cylindrical and includes at least one connecting feature on its external surface configured to be connected to the housing either directly or indirectly through a connecting collar.

Further, an upper portion of the first applicator member gradually tapers asymmetrically from a proximal end to a distal end portion thereof such that the upper portion of the first applicator member is off-centered with respect to the longitudinal axis of the applicator head. The upper portion of the first applicator member includes the upper surface and has at least one sidewall that depends downward from the upper surface.

Further, the at least one sidewall of the first applicator member includes at least two opposite faces namely a front sidewall, a rear sidewall opposite to the front face, a left sidewall and a right sidewall. An outer surface of the rear sidewall is concavely curved along a longitudinal direction. An outer surface of the front sidewall has a convex curve that is followed by a concave curve when seen from a proximal end to a distal end of the front face. The front sidewall further includes at least two coupling protrusions that are spaced apart axially on the front sidewall.

According to yet another aspect of the present disclosure, the product delivery passageway extending through the first applicator member is non-linear. More particularly, a lower portion of the product delivery passageway extending through the lower portion of the first applicator member is parallel to the longitudinal axis of the applicator head, and an upper portion of the product delivery passageway extending through the upper portion of the first applicator member is non-parallel and inclined with respect to the longitudinal axis of the applicator head.

According to yet another aspect of the present disclosure, the upper portion of the product delivery passageway has a narrower width than the width of the lower portion of the product delivery passageway.

According to a preferred embodiment of the present disclosure, the second applicator member comprises the upper surface and a peripheral wall that depends downward from the upper surface. The peripheral wall of the second applicator member is open on one side. Particularly, the peripheral wall includes a left side wall, a front sidewall, and a right sidewall. Further, the peripheral wall is open on the rear side opposite the front sidewall of the second applicator member. Each of the left and right sidewalls of the second applicator member is generally triangular that becomes narrower downward. The upper surface of the second applicator member is convexly curved along the longitudinal axis of the applicator surface. The second portion of the recessed concavity is located adjacent to a rear edge of the second applicator member and is recessed from the upper surface.

According to yet another aspect of the present disclosure, the second applicator member includes at least two coupling grooves that protrude transversely to the longitudinal axis of the applicator head from an inner surface of the front side wall towards a rear opening of the second applicator member. Further, the front sidewall of the first applicator member includes at least two coupling protrusions that are received in corresponding at least two coupling grooves of the second applicator member, in order to couple the second applicator member with the first applicator member. The two coupling protrusions may be closely spaced or remotely spaced from each other. Additionally, each coupling protrusion primarily secures precisely by means of snap or interference/fitment with the respective coupling groove. Additionally, the two coupling grooves can be constructed of any diameter and depth corresponding to the dimensions of the two coupling protrusions. In alternate embodiments, the second applicator member may be secured to the first applicator member on the front sidewall of the first applicator member, for example, by a press-fit, snap-fit, adhesive, and/or engagement by one or more engagement features or by any other means of engagement known in the art.

The cosmetic dispensing package in accordance with an embodiment of the present disclosure, comprises the housing, the inner container, a button unit, the applicator head, and a pump assembly. The cosmetic dispensing package further comprises a cap. The inner container, the applicator head, and the pump assembly are connected to the housing, and the button unit is connected to the inner container. The inner container stores the fluid product (not shown) which is to be applied on a keratinous surface, wherein the fluid product is selected from at least one of the cosmetic fluid products or medicinal liquid products. The fluid product stored in the inner container is a flowable fluid product e.g. a solution, suspension, a viscous liquid, etc. The cap is detachably mounted on the neck of the housing to prevent the accumulation of dirt and dust on the applicator head. The cap and the housing may be coupled using any suitable engagement means capable of removably coupling the cap and the housing for e.g. snap fitment, j-lock, magnetic engagement, screw threads, etc.

The button unit is located at a proximal end of the inner container and is connected by a snap fitment to the inner container. Further, the body of the button unit remains outside of the housing and is accessible to a user for pushing the inner container along the longitudinal axis while using the cosmetic package. The inner container is configured to move in an upward and downward direction along the longitudinal axis of the housing. Preferably, the inner container is detachably fitted within the housing.

A piston tightly fits inside the inner container at the proximal end of the inner container. The piston is movable along the longitudinal axis of the inner container and reaches near the distal end of the inner container when the fluid product inside the inner container is completely used up.

The pump assembly is disposed at the distal end of the inner container. Further, a lower portion of the pump assembly is housed inside a hollow cavity of the inner container while an upper portion of the pump assembly is housed inside the hollow cavity of the housing. The pump assembly is preferably a vacuum sealed pump assembly. The vacuum sealed pump assembly further includes a receptacle, a vacuum sealed member, a check valve, and a conduit. The check valve is disposed on the proximal end of the receptacle. The check valve allows a one-way suction of the liquid product stored inside the inner container, wherein the one-way suction is typically from a proximal end to a distal end of the pump assembly.

In an embodiment, the pump assembly comprises a holder detachably connected to the inner container. An insert is disposed on the distal end of the holder such that the holder is slidable with respect to the insert and is configured to move inside a hollow cavity of the upper portion of the holder. The insert houses a spring member and the conduit which is disposed inside the vacuum sealed member. The spring member biases the inner container in the downward direction.

Further, the insert is fixedly connected to a lower portion of the applicator head in such a way that a lower portion of the product delivery passageway is aligned with the conduit of the pump assembly forming a passage that allows the flow of the fluid product from the receptacle. The product delivery passageway is aligned with the conduit of the pump assembly to form a single passageway for carrying the fluid product from the inner container to the applicator head.

According to the embodiment, a distal opening at the open distal end of the housing is enclosed by a lower end of the connecting collar. The inner surface of the connecting collar is connected to the outer surface at the distal end of the housing by snap fitment. It would not be outside the scope of present disclosure if the connecting collar is connected to the housing by a threaded engagement, a magnetic engagement, and the like. Further, the connecting collar is connected to the applicator head by a snap fitment. The lower portion of the first applicator member comprises at least one connecting groove on its external surface which receives an internal protrusion of the connecting collar for snap-fitment. It would not be outside the scope of present disclosure if the connecting collar is connected to the applicator head by a threaded engagement, a magnetic engagement, and the like.

During use, the user applies pushing force on the button unit pushes the inner container in the upward direction in the housing which in turn pushes the holder and the receptacle of the pump assembly in the upward direction resulting in compression of the spring member between the holder and the insert of the pump assembly. The compression of the spring member towards the insert causes the vacuum sealed member to move in the upward direction and open an orifice present in the conduit of the pump assembly resulting in the flow of fluid product from the receptacle to the passageway of the conduit. Further, the fluid product flows from the co-axially aligned passageways of the conduit of the pump assembly and the product delivery passageway of the applicator head.

As the push force from the button unit is released, the inner container moves in a downward direction, and the spring member again expands creating a suction force that causes the check valve to open, and the fluid product from the inner container enters the receptacle of the pump assembly and simultaneously the piston of the inner container travels in the upward direction due to the force generated. The piston displaces in the upward direction up to a certain height equivalent to balance the pressure created inside the inner container. The displacement of the piston allows the movement of the fluid product towards the distal end of the inner container. The fluid product now available in the receptacle of the pump assembly can be dispensed again through the applicator head by pushing the button unit. The fluid product released from the applicator head can be applied to the skin of the user. The applicator head applies the liquid product on the surface of the user's skin, lips, eyes, and the like.

In other alternate embodiments, the pump assembly may be a dip tube assembly or any other assembly capable of sucking product from the inner container to the actuator.

In the current embodiment, a delivery mechanism for dispensing a fluid product is an airless pump with a replaceable inner container. In other implementations, any type of airless pump may be employed. However, in yet other implementations, any suitable delivery mechanism may be used.

The following is a discussion of examples, without limitation, of delivery mechanisms for dispensing a fluid product. The first example may be implemented using a click or a reverse click operation, whereby the user may operate the cosmetic dispensing package by moving the applicator head relative to the housing in either a clockwise or counter clockwise direction.

Another example delivery mechanism for dispensing the fluid product maybe a squeeze operation. In certain embodiments wherein the delivery mechanism is a squeeze operation, when pressure is applied to the housing such as a tube containing the fluid product, the fluid product in the tube may be forced, by the squeezing action, through the applicator head via a product delivery passageway for application to the user's skin.

In yet another example, a delivery mechanism for dispensing the fluid product maybe by a pressurized dispenser, such as an aerosol dispenser. In certain embodiments wherein the delivery mechanism is an aerosol delivery mechanism, the composition will be held under pressure in housing and will be dispersed along with an aerosol propellant in response to actuation by a user. Actuation may be by depressing, rotating, tilting, or otherwise manipulating the applicator head, pressing a button, and/or by any other suitable dispensing mechanism. Details of the construction and propellant of an aerosol dispenser are within the skill of one of ordinary skill in the art and will, therefore, not be described in detail herein.

According to an aspect of the present disclosure, the cosmetic dispensing package is of an elongated cylindrical configuration. However, in alternate embodiments, the cosmetic dispensing package may be of an elongated square, polygonal configuration, oval, triangular, heart, or any other configuration known in the art.

According to an embodiment, the housing, the inner container, and the cap may be made of a rigid material like glass, metal, hard plastic, a biodegradable material, or any other material known in the art. However, in alternate embodiments, the housing and the cap may be made of a flexible material like flexible polymeric material or any other material known in the art.

The present disclosure is not limited to, the broadest in accordance with the basic idea disclosed herein. It should be interpreted as having a range. Skilled artisans may implement the pattern of the non-timely manner by combining, replacement of the disclosed embodiments shape, this would also do not depart from the scope of the disclosure. In addition, those skilled in the art may readily change or modify to the disclosed embodiments, based on the present specification, such changes or modifications also belong to the scope of the present disclosure will be apparent.

BRIEF DESCRIPTION OF THE DRAWINGS

A more complete appreciation of the present disclosure and many of the attendant advantages thereof will be readily obtained as the same becomes better understood by reference to the following detailed description when considered in connection with the accompanying drawings, wherein.

DETAILED DESCRIPTION

Figure 1:
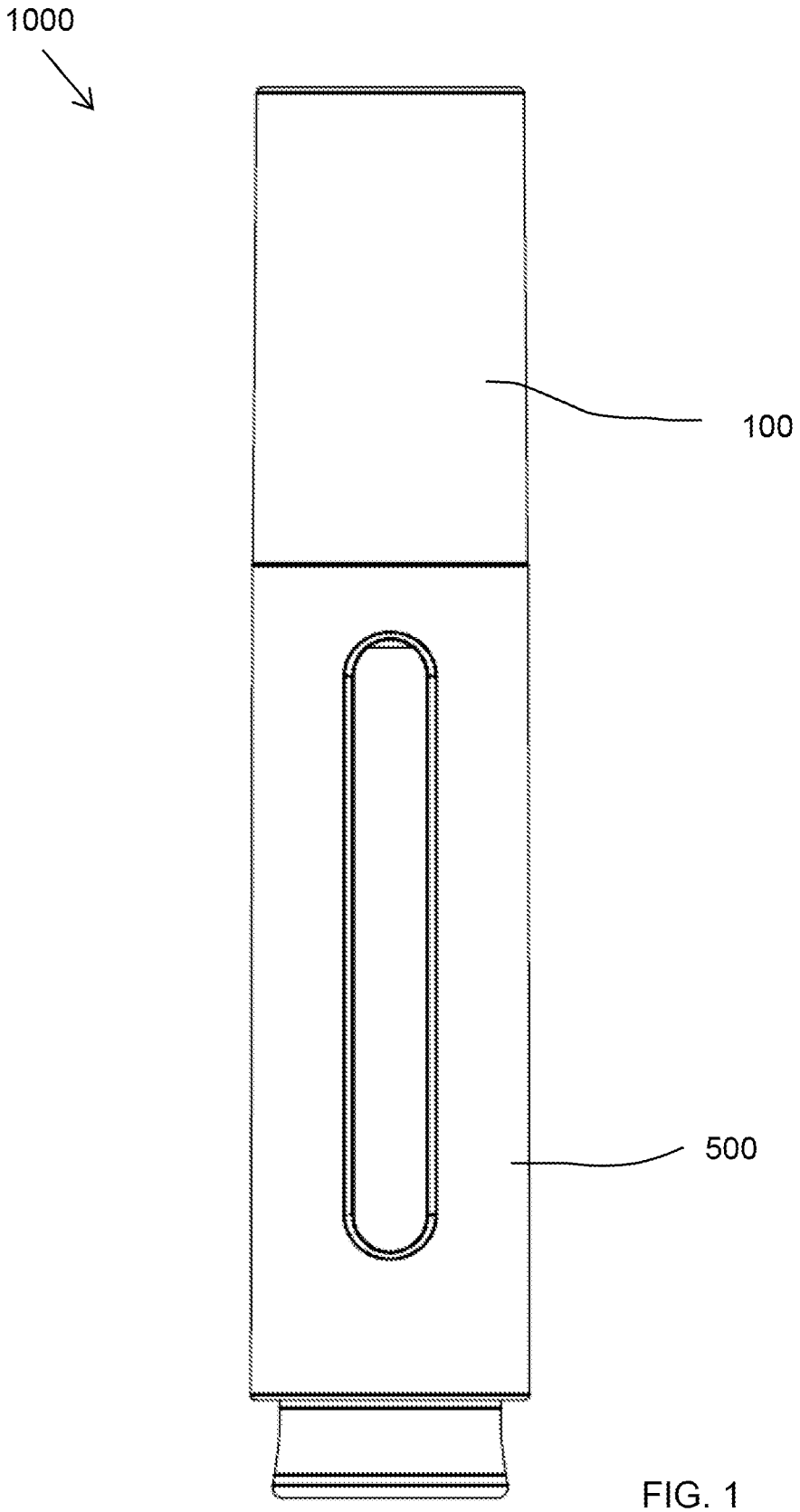
FIG. 1 illustrates a front view of a cosmetic dispensing package according to a preferred embodiment of the present disclosure.

As shown throughout the drawings, like reference numerals designate like or corresponding parts. While illustrative embodiments of the present disclosure have been described and illustrated above, it should be understood that these are exemplary of the disclosure and are not to be considered as limiting. Additions, deletions, substitutions, and other modifications can be made without departing from the spirit or scope of the present disclosure. Accordingly, the present disclosure is not to be considered as limited by the foregoing description.

Throughout this specification, the terms "comprise," "comprises," "comprising" and the like, shall consistently mean that a collection of objects is not limited to those objects specifically recited.

A "median longitudinal plane" divides an element longitudinally into two equal and symmetrical parts.

Figure 2:
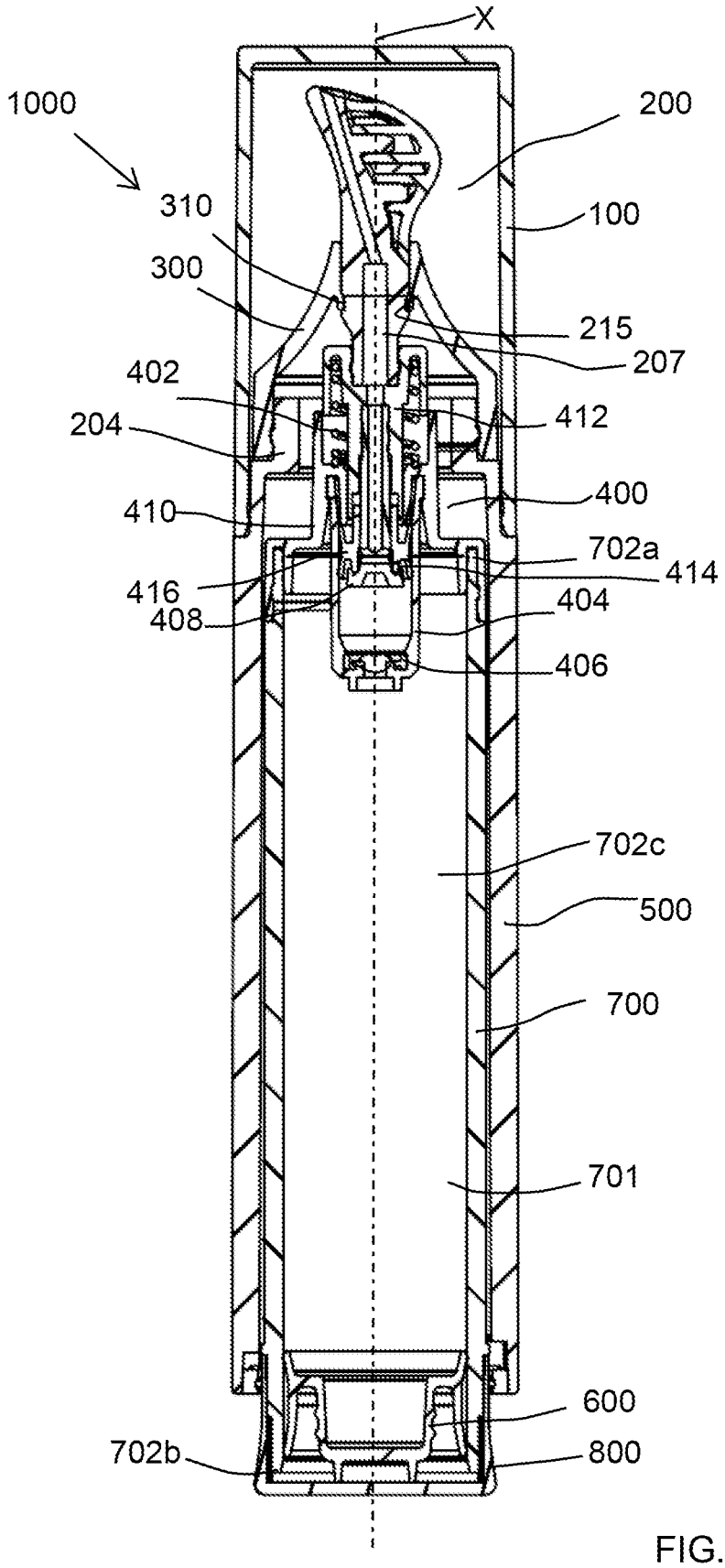
FIG. 2 illustrates a longitudinal cross sectional view of the cosmetic dispensing package of FIG. 1.
Figure 3:
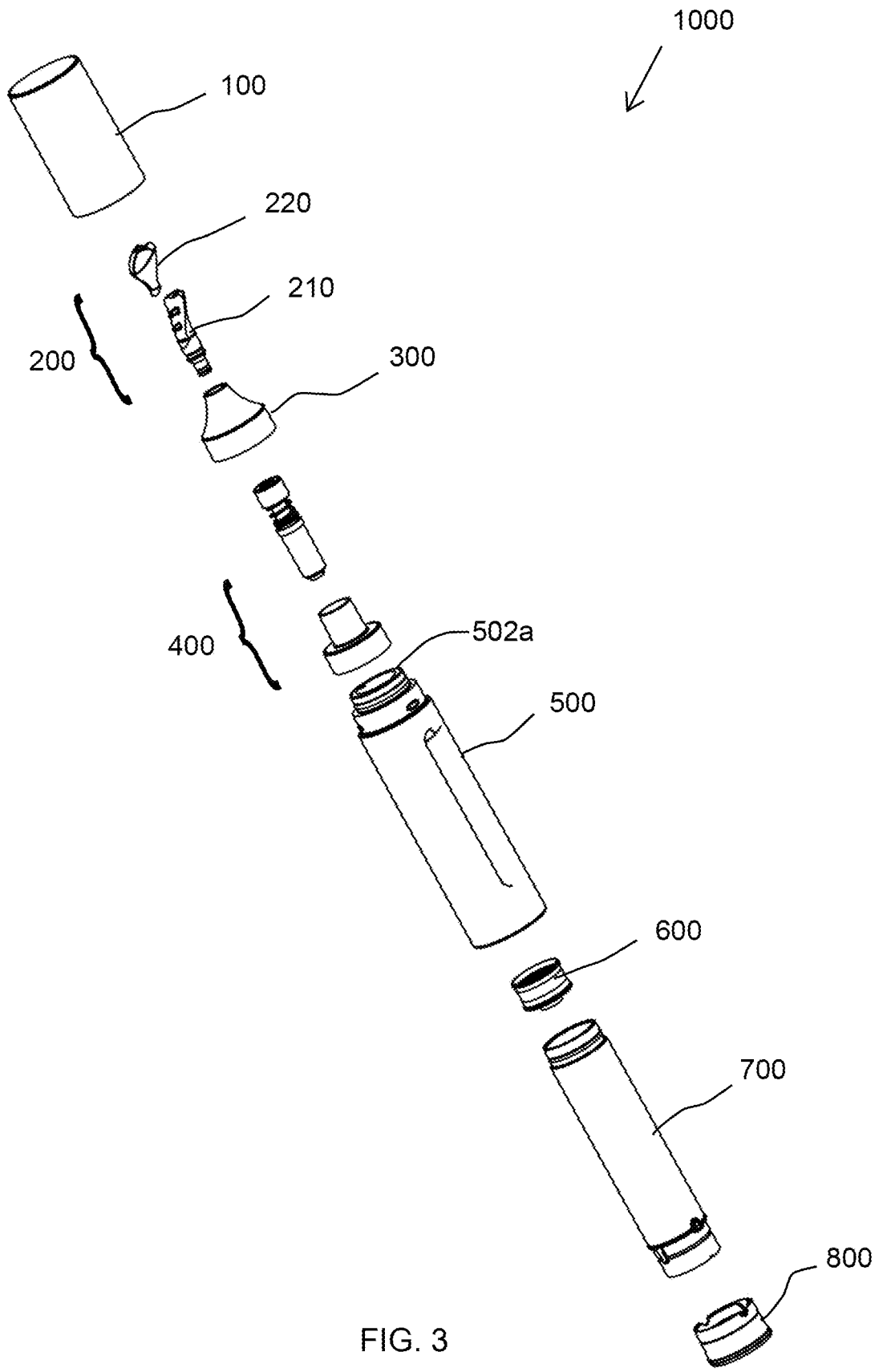
FIG. 3 illustrates an isometric exploded view of the cosmetic dispensing package of FIG. 1.

FIGS. 1 to 3 show an illustrative cosmetic dispensing package 1000 according to a preferred embodiment of the present disclosure. The cosmetic dispensing package 1000 comprises a housing 500, an applicator head 200 coupled to one end of the housing 500, and a cap 100 configured to be coupled to the housing 500 when the cosmetic dispensing package is not in use. This cosmetic dispensing package 1K) extends longitudinally along a longitudinal axis X.

According to an embodiment of the present disclosure, a longitudinal axis X of the applicator head 200 coincides with the longitudinal axis X of the cosmetic dispensing package 1000. However, in alternate embodiments, the longitudinal axis X of the applicator head 200 may not coincide with the central longitudinal axis X of the cosmetic dispensing package 1000.

In the present implementation, the housing 500 is configured to receive an inner container 700 having a reservoir 701 for containing a fluid product (not shown) including a cosmetic, care, or pharmaceutical product. The cosmetic, care, or pharmaceutical product includes viscous cosmetics, mascara, eyebrow powder, lip gloss, hair color, cheek blush, skincare, under-eye cosmetics, pharmaceutical, and like products.

FIGS. 4-8 shows the applicator head 200 according to an embodiment of the present disclosure. The applicator head 200 includes a first applicator member 210 and a second applicator member 220 coupled to one side of the first applicator member 210. The applicator head 200 includes an applicator surface 230 defined by an upper surface of the applicator head 200. The applicator surface 230 is adapted to apply and dispense the fluid product. More particularly, the applicator surface 230 of the applicator head 200 is defined by an upper surface 211 of the first applicator member 210 together with an upper surface 221 of the second applicator member 220.

Figure 8:
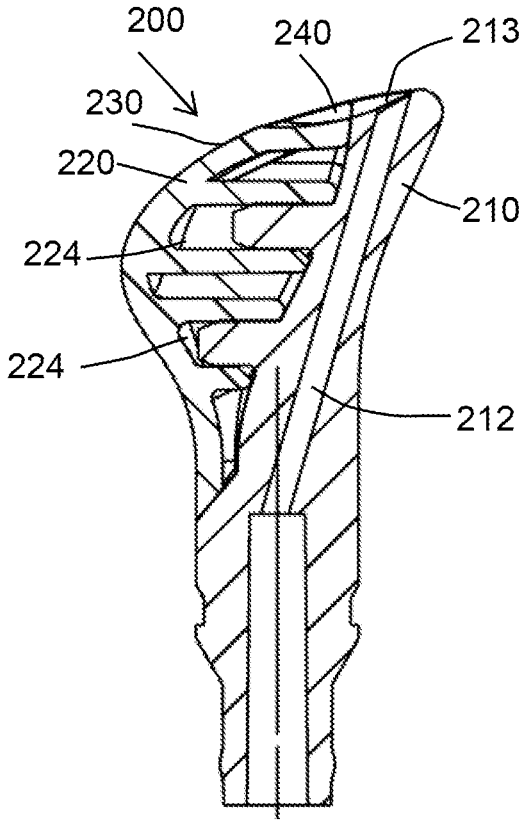
FIG. 8 illustrates a cross sectional view of the applicator head of FIG. 4.
Figure 9:
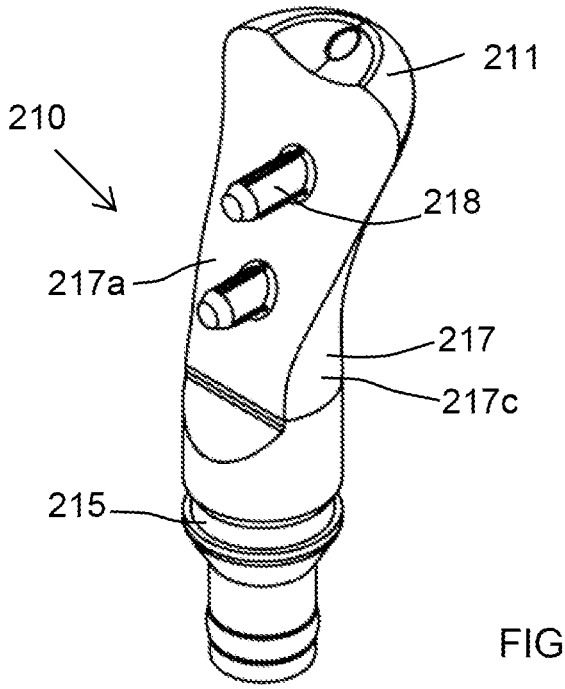
FIG. 9 illustrates an isometric view of a first applicator member of the applicator head of FIG. 4.

Further, a product delivery passageway 212 extends through the body of the first applicator member 210, terminating at a discharge opening 213 in the applicator surface 230 through which a fluid product is dispensed, as shown in FIG. 8.

According to an aspect of the present disclosure, the second applicator member 220 is made of a material different from the material of the first applicator member 210. The second applicator member 220 is made of a thermal material with high thermal effusivity compared to that of the user's surface to be treated. The thermal effusivity of the second applicator member 220 is higher than that of the first applicator member 210. More particularly, the second applicator member 220 is made of a material capable of holding and retaining a thermal charge. In one implementation, the second applicator member 220 can be made of stainless steel. However, in other implementations, any suitable material may be used that is capable of retaining heat or cold during the application of the fluid product. Examples of other suitable materials include, without limitation, metals (e.g., aluminum, titanium, steel, nickel, tin, copper, brass, alloys thereof, etc.), ceramics, stones, high-density plastics, composites, or the like.

The first applicator member 210 may be made of a thermoplastic polymer, for example, which is non-reactive with the fluid product stored in the inner container 700. In other implementations, the first applicator member 210 may be made of virtually any other material that is non-reactive or resistant to the fluid product being dispensed, such as various metals, plastics, ceramics, composites, or the like. Preferably, the first applicator member 210 may be made of polyethylene, polypropylene, ABS, silicon, or any other suitable material. PVC, PU, EVA, SIS-SEB, nitrile, silicone, EPDM, Hytrel®, Pebax®, Santoprene®, or other thermoplastics, elastomers, this list not being limiting. According to an embodiment of the present disclosure, at least a part and preferably the complete first applicator member 210 can be made by molding, e.g. by injection-molding.

Figure 4:
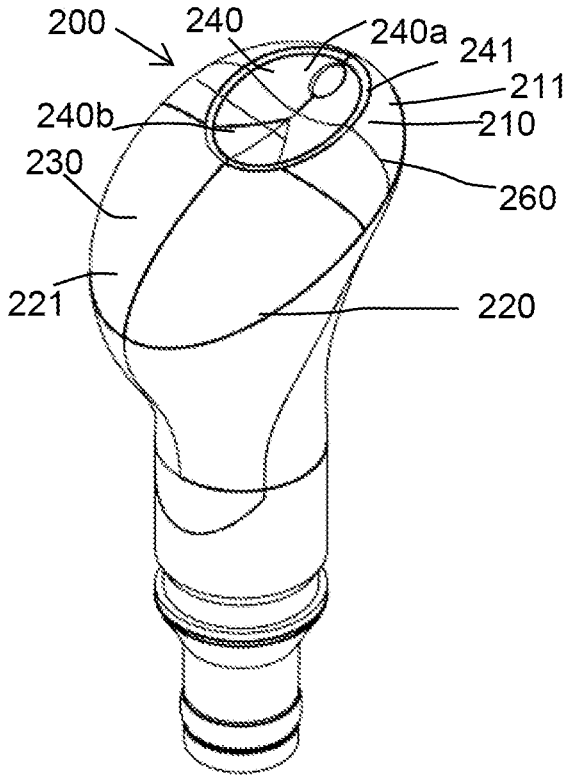
FIG. 4 illustrates an isometric view of an applicator head of the cosmetic dispensing package of FIG. 1.
Figure 5:
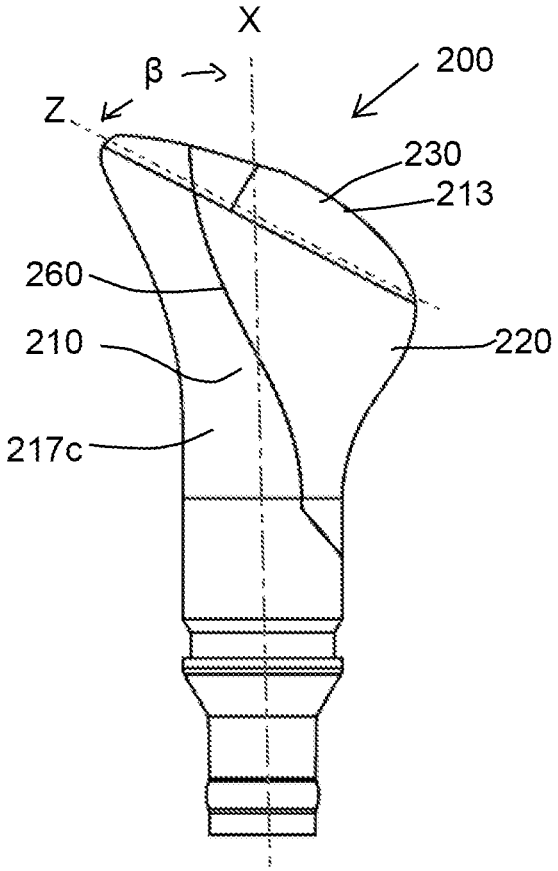
FIG. 5 illustrates a side view of the applicator head of FIG. 4.

Referring to FIGS. 4-5, the applicator surface 230 is convex (in a longitudinal direction) and angled. The applicator surface 230 is curvilinear or curving in an ever-changing slope to allow for easy spreading of the fluid product on the skin of a user. Further, the changeable radius curvature or continuously changing angle of the sloped applicator surface 230 facilitates even distribution and easy application of the fluid product. In the present embodiment, a peripheral edge of the applicator surface 230 of the applicator head 200 is rounded for comfort during the application, as shown in FIG. 4. In alternate embodiments, the peripheral edge of the applicator surface 230 may not be rounded.

Referring FIG. 8, the discharge opening 213 is located within a recessed concavity 240 formed on the applicator surface 230. The recessed concavity 240 creates a suitable surface or a receptacle to collect the fluid product dispensed out from the discharge opening 213. As shown in FIG. 4, the recessed concavity 240 is an indentation into the applicator surface 230 with the discharge opening 213 formed therein. As seen in FIGS. 4 and 5, the applicator surface 230 and the recessed concavity 240 both are angled with respect to the longitudinal axis X. The recessed concavity 240 has a sufficient depth so that excess fluid product can be held within the recessed concavity 240. The recessed concavity 240 extends over more than a quarter of the width b of the applicator surface 230 as well as over more than a quarter of its length a, refer FIG. 6. This dimension is suitable for storing a makeup product. The recessed concavity 240 is farther from a proximal end 231 of the applicator surface 230 and is close to a distal end 232 of the applicator surface 230, see FIG. 6. It has a maximum depth of dimension such that is easier to empty the recessed concavity 240 on contact with the skin. The maximum depth of the recessed concavity 240, measured along a median longitudinal plane containing the longitudinal axis X, is less than equal to 1 mm, preferably between 0.5 mm to 1 mm.

As shown in FIG. 5, the applicator surface 230 has a longitudinal axis Z that is inclined relative to the longitudinal axis X of the cosmetic dispensing package 1000, in particular by an angle β between 15 and 75°, and preferably between 55-70°. This design facilitates the application of the applicator surface 230 to the user's skin.

Figure 6:
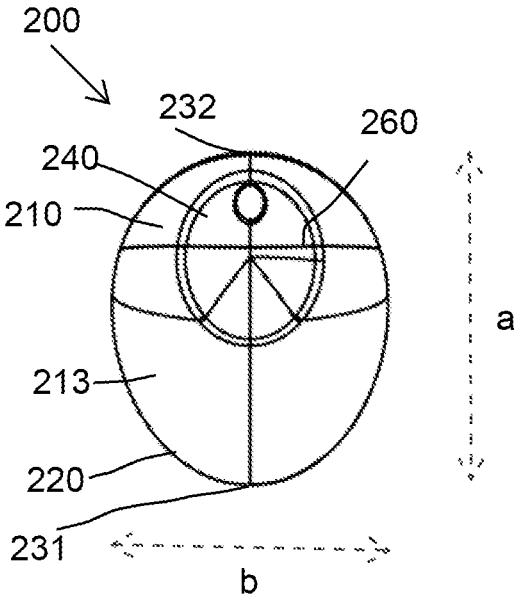
FIG. 6 illustrates a top view of the applicator head of FIG. 4.
Figure 7:
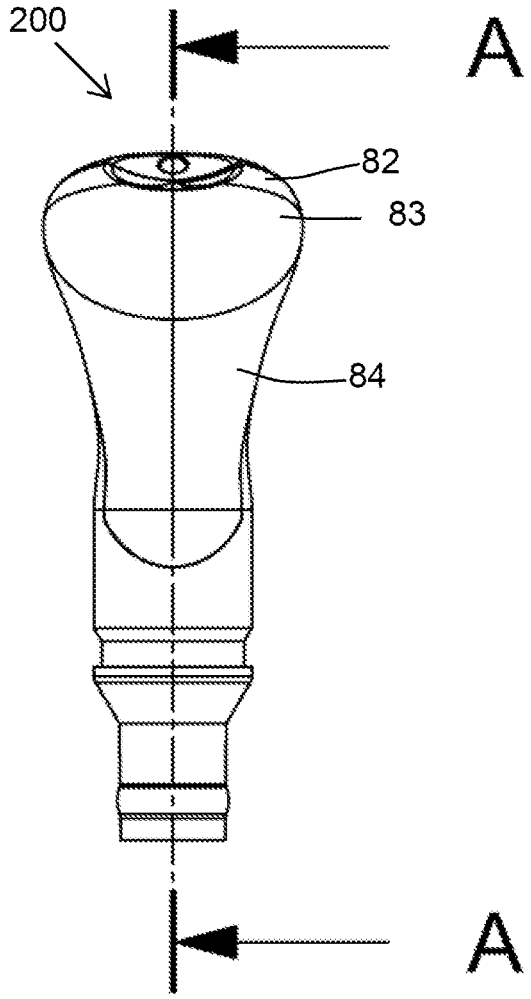
FIG. 7 illustrates a front view of the applicator head of FIG. 4.

The applicator head 200 has a generally elongated shape symmetrical with respect to a median longitudinal plane containing the longitudinal axis X. The recessed concavity 240 on the applicator surface 230 is elongated along a longitudinal axis Z and has shape, for example, oval, elliptical, or oblong. The recessed concavity 240 is bordered by a peripheral surface 241 whose width varies from 0.6 mm to 0.2 mm. According to a preferred embodiment as shown in FIGS. 5 and 6, the applicator surface 230 has an elliptical shape elongated along the longitudinal axis Z.

The dimensions of the recessed concavity 240 can be chosen as a function of the quantity of product which it is desired to have optionally retained. Preferably, the dimensions of the recessed concavity 240 and of the applicator surface 230 are the following, when the recessed concavity 240 is viewed in the top view, the maximum width of the recessed concavity 240, measured perpendicular to the longitudinal axis Z of the applicator surface 230, is between 2 mm and 7 mm, and preferably between 3 mm and 6 mm, the maximum length of the recessed concavity 240, measured along the longitudinal axis Z of the applicator surface 230 is between 6 mm and 10 mm, and preferably between 6 mm and 8 mm, the maximum width "b" (see FIG. 6) of the applicator surface 230, measured perpendicular to the longitudinal axis X of the is between 5 mm and 15 mm, and preferably between 8 mm and 12 mm, the length "a" (see FIG. 6) of the applicator surface 230, measured along the longitudinal axis Z of the applicator surface, is between 10 mm and 18 mm, and preferably between 11 mm and 15 mm.

The second applicator member 220 is coupled to one side of the first applicator member 210 to define the applicator head 200 such that an outer surface of the first applicator member 210 and an outer surface of the second applicator member 220 meet at an interface 260. The first applicator member 210 and a second applicator member 220 are aligned such that the applicator head 200 is substantially smooth and continuous across an interface 260. Further, in the embodiment under consideration, the upper surface 211 of the first applicator member 210 and the upper surface 221 of the second applicator member 220 meet at the interface 260 defined on the applicator surface 230, see FIG. 4.

A first portion 240*a* of the recessed concavity 240 is formed on the first applicator member 210 and a second portion 240*b* of the recessed concavity 240 is formed on the second applicator member 220 such that when the first applicator member 210 and a second applicator member 220 are coupled the first and second portions 240*a*. 240*b* of the recessed concavity 240 align to complete the recessed concavity 240. The first portion 240*a* defines an upper portion of the recessed concavity 240 and the second portion 240*b* defines a lower portion of the recessed concavity 240. At least a portion of the interface 260 of the first applicator member 210 and the second applicator member 220 lies in the recessed concavity 240 on the applicator surface 230, as shown in FIG. 4.

The discharge opening 213 is positioned in the first portion 240*a* of the recessed concavity 240 in the first applicator member 210 and is spaced away from the interface 260 located in the recessed concavity 240. The recessed concavity 240 has a maximum depth defined at the interface 260. Therefore, when the product is dispensed out from the discharge opening 213 the fluid product starts gravitating towards the interface 260 before filling up the recessed concavity 240 and comes in contact with the thermal material of the second applicator member 220.

Furthermore, at least 60% of the applicator surface 230 is constituted by the upper surface 221 of the second applicator member 220 and at least 20% of the applicator surface 230 is constituted by the upper surface 211 of the first applicator member 210. The large upper surface 221 of the second applicator member 220 provides a thermal sensation to the user's skin and allows the users to massage a larger area of the keratinous surface.

When the fluid product is applied, the user can bring the fluid product contained in the recessed concavity 240 into contact with his/her skin. The applicator surface 230 is used for applying the dispensed fluid product and as well as providing thermal sensation to the user's skin. The second applicator member 220 allows the users to massage a larger area of the keratinous surface.

In this implementation, see FIGS. 4 and 6, the applicator surface 230 is shown as being elliptical in shape. In alternate embodiments, however, the applicator surface 230 may have any other suitable shape and size, surface finish desired for a given application.

Further, FIGS. 9-12 show the first applicator member 210 according to a preferred embodiment. The first applicator member 210 comprises a lower portion 214 that is cylindrical and includes at least one connecting feature 215 on its external surface configured to be connected to the housing 500 either directly or indirectly through a connecting collar 300.

An upper portion 216 of the first applicator member 210 makes an angle with respect to the longitudinal axis X of the applicator head 200. When seen from the side view, the upper portion 216 of the first applicator member 210 gradually tapers asymmetrically from a proximal end to a distal end portion thereof such that the upper portion 216 of the first applicator member 210 is off-centered with respect to the longitudinal axis X of the applicator head 200 (see FIG. 5). The upper portion 216 of the first applicator member 210 includes the upper surface 211 and has at least one sidewall 217 that depends downward from the upper surface 211.

Figure 10:
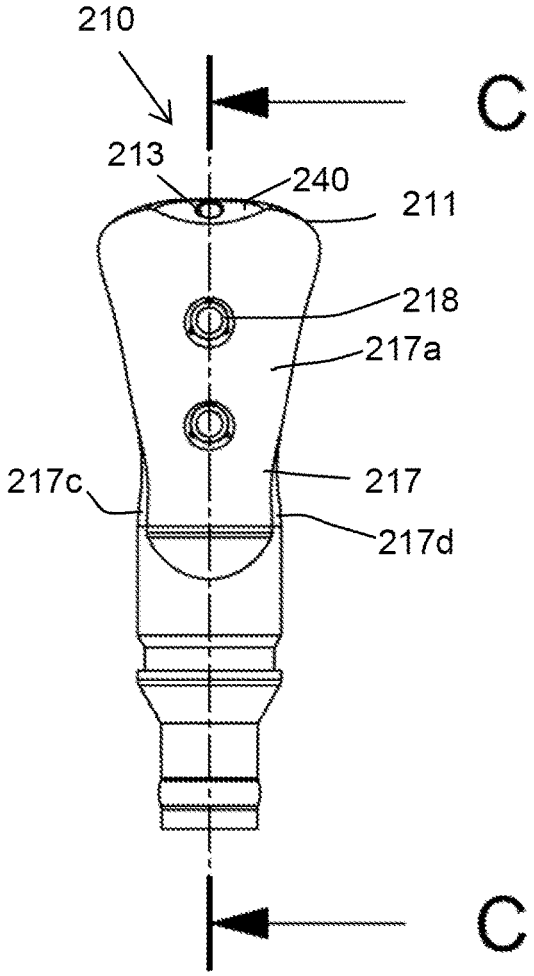
FIG. 10 illustrates a front side view of the first applicator member of FIG. 9.
Figure 11:
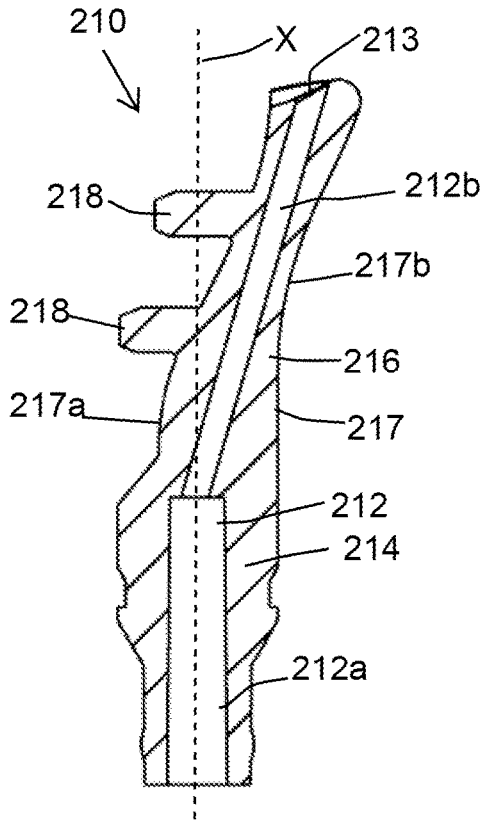
FIG. 11 illustrates a cross sectional view of the first applicator member of FIG. 9.
Figure 12:
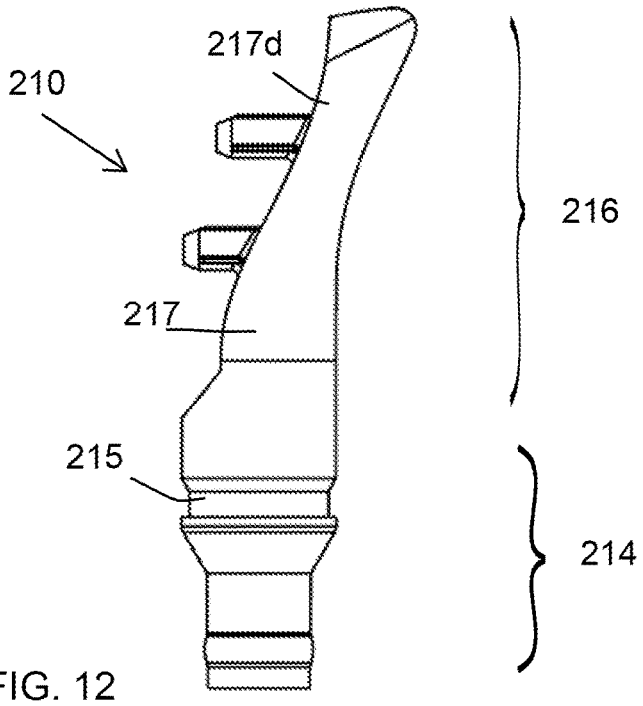
FIG. 12 illustrates a side view of the first applicator member of FIG. 9.
Figure 13:
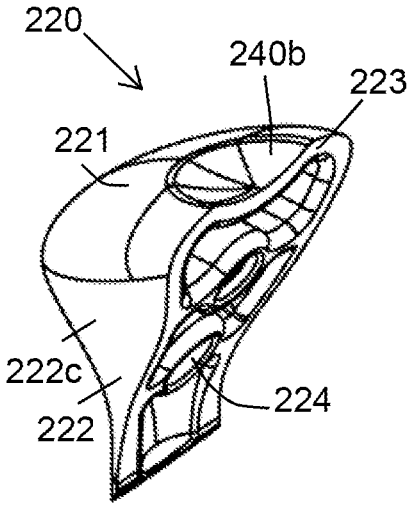
FIG. 13 illustrates an isometric view of a second applicator member of the applicator head of FIG. 4.
Figure 14:
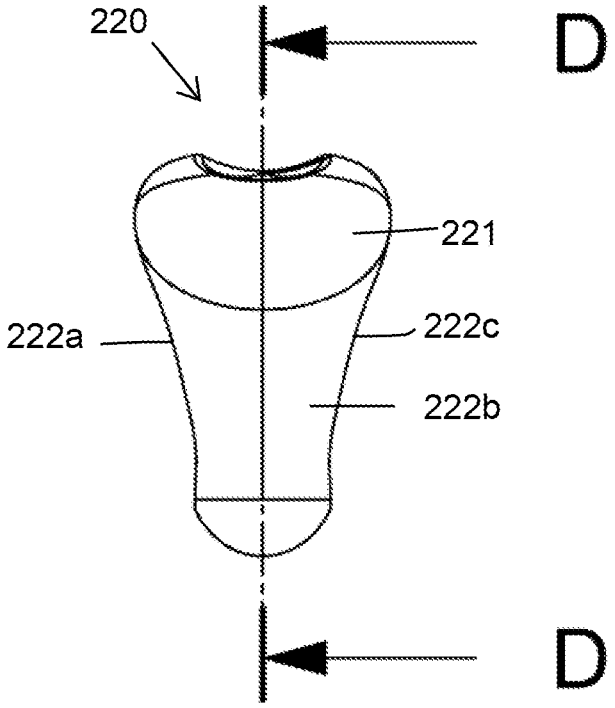
FIG. 14 illustrates a front view of the second applicator member of FIG. 13.
Figure 15:
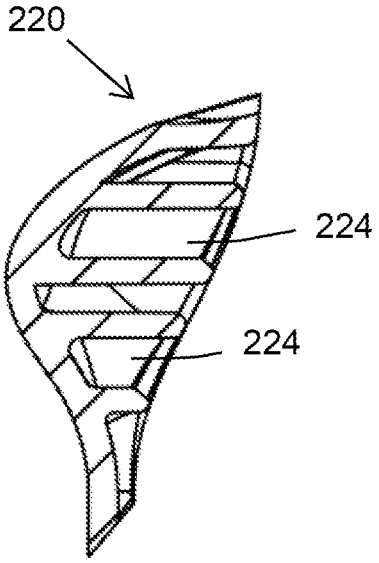
FIG. 15 illustrates a cross sectional view of the second applicator member of FIG. 13.
Figure 16:
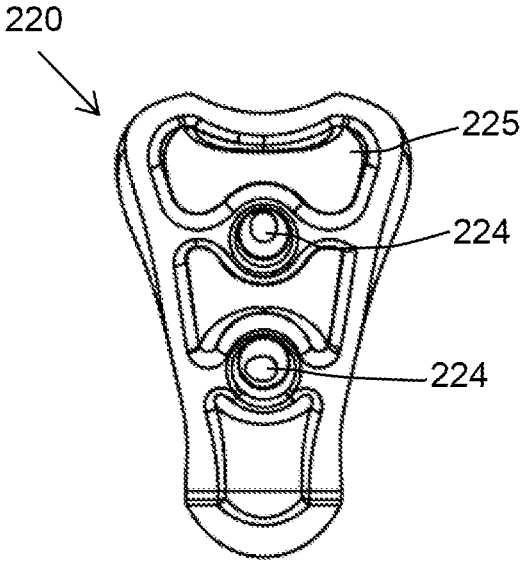
FIG. 16 illustrates a back view of the second applicator member of the FIG. 13.

Referring to FIGS. 10 and 11, the at least one sidewall 217 includes at least two opposite faces namely a front sidewall 217*a*, a rear sidewall 217*b*, a left sidewall 217*c* and a right sidewall 217*d*. An outer surface of the rear sidewall 217*b* is concavely curved along a longitudinal direction. An outer surface of the front sidewall 217*a* has a convex curve that is followed by a concave curve when seen from a proximal end to a distal end of the front face 217*a*. The front sidewall 217*a* includes at least two coupling protrusions 218 that are spaced apart axially on the front sidewall 217*a*. Each of the left sidewall 217*c* and the right sidewall 217*d* has a concave curve proximate its distal end and has a width that becomes generally narrower towards the distal end. Each of the front sidewall 217*a* and the rear sidewall 217*b* of the first applicator member 210 has a width that increases towards the distal end of the first applicator member 210.

Referring to FIG. 11, the product delivery passageway 212 extending through the first applicator member 210 is non-linear. More particularly, a lower portion 212*a* of the product delivery passageway 212 extending through the lower portion 214 of the first applicator member 210 is parallel to the longitudinal axis X of the applicator head 200, and an upper portion 212*b* the product delivery passageway 212 at the upper portion 216 of the first applicator member 210 is non-parallel and inclined with respect to the longitudinal axis X of the applicator head 200. Further, the upper portion 212*b* of the product delivery passageway 212 has a narrower width than the width of the lower portion 212*a* of the product delivery passageway 212.

FIGS. 13-16 show the second applicator member 220 according to a preferred embodiment of the present disclosure. The second applicator member 220 comprises the upper surface 221 and a peripheral wall 222 that depends downward from the upper surface 221. The peripheral wall 222 of the second applicator member 220 is open on one side. The peripheral wall 222 includes a left sidewall 222*a*, a front sidewall 222*b*, and a right sidewall 222*c*. Further, the peripheral wall 222 is open on the rear side opposite the front sidewall 222*b* of the second applicator member 220. Each of the left and right sidewalls 222*a* and 222*c* is generally triangular that becomes narrower downward (see FIG. 13). The upper surface 221 of the second applicator member 220 is convexly curved along the longitudinal axis Z. The second portion 240*b* of the recessed concavity 240 is located adjacent to a rear edge 223 of the second applicator member 220 and is recessed from the upper surface 221.

In the exemplary embodiment, referring to FIGS. 8, 9, 13, 15 and 16, the second applicator member 220 includes at least two coupling grooves 224 that protrude transversely to the longitudinal axis X of the applicator head 200 from an inner surface of the front sidewall 222*b* towards a rear opening 225 of the second applicator member 220. Further, the front sidewall 217*a* of the first applicator member 210 includes at least two coupling protrusions 218 that are received in corresponding at least two coupling grooves 224 of the second applicator member 220, in order to couple the second applicator member 220 with the first applicator member 210. The two coupling protrusions 218 may be closely spaced or remotely spaced from each other. Additionally, each coupling protrusion 218 primarily secures precisely by means of snap or interference/fitment with the respective coupling groove 224. Additionally, the two coupling grooves 224 can be constructed of any diameter and depth corresponding to the dimensions of the two coupling protrusions 218. In alternate embodiments, the second applicator member 220 may be secured to the first applicator member 210 on the front sidewall 217*a* of the first applicator member 210, for example, by a press-fit, snap-fit, adhesive, and/or engagement by one or more engagement features or by any other means of engagement known in the art.

Referring to FIG. 1 to 3, illustrate a cosmetic dispensing package 100) in accordance with an embodiment of the present disclosure. The cosmetic dispensing package 1000 comprises the housing 500, the inner container 700, a button unit 800, the applicator head 200, and a pump assembly 400. The cosmetic dispensing package 1000 further comprises a cap 100. The inner container 7M), the applicator head 200, and the pump assembly 400 are connected to the housing 500, and the button unit 800 is connected to the inner container 700. The inner container 700 stores the liquid product (not shown) which is to be applied on a surface, wherein the liquid product is selected from at least one of the cosmetic fluid products or medicinal liquid products. The fluid product stored in the inner container 700 is a flowable fluid product e.g. a solution, suspension, a viscous liquid, etc. The cap 100 is detachably mounted on a neck 204 of the housing 500 to prevent the accumulation of dirt and dust on the applicator head 200. The cap 100 and the housing 500 may be coupled using any suitable engagement means capable of removably coupling the cap 100 and the housing 500 e.g. snap fitment, j-lock, magnetic engagement, screw threads, etc.

The button unit 800 is located at a proximal end 702 *b* of the inner container 700 and is connected by a snap fitment to the inner container 700. Further, the body of the button unit 800 remains outside of the housing 500 and is accessible to a user for pushing the inner container 700 along the longitudinal axis X while using the cosmetic dispensing package 1000. The inner container 700 is configured to move in an upward and downward direction along the longitudinal axis X of the housing 500. Preferably, the inner container 700 is detachably fitted within the housing 500.

A piston 600 tightly fits inside the inner container 700 at the proximal end 702*b* of the inner container 700. The piston 600 is movable along the longitudinal axis X of the inner container 700 and reaches near the distal end 702*a* of the inner container 700 when the fluid product inside the inner container 700 is completely used up.

Further, as shown in FIGS. 2 and 3, a pump assembly 400 is disposed at the distal end 702*a* of the inner container 700. Further, a lower portion of the pump assembly 400 is housed inside a hollow cavity 702*c* of the inner container 700 while an upper portion of the pump assembly 400 is housed inside the hollow cavity of the housing 500.

The pump assembly 400 is preferably a vacuum sealed pump assembly 400.

As shown in FIGS. 2 and 3, the vacuum sealed pump assembly 400 further includes a receptacle 404, a vacuum sealed member 416, a check valve 406, and a conduit 408. The check valve 406 is disposed on the proximal end of the receptacle 404. The check valve 406 allows a one-way suction of the liquid product stored inside the inner container 700, wherein the one-way suction is typically from a proximal end to a distal end of the pump assembly 400.

In an embodiment, the pump assembly 400 comprises a holder 410 detachably connected to the inner container 700.

An insert 412 is disposed on the distal end of the holder 410 such that the holder 410 is slidable with respect to the insert 412 and is configured to move inside a hollow cavity of the upper portion of the holder 410. The insert 412 houses a spring member 402 and the conduit 408 which is disposed inside the vacuum sealed member 416. The spring member 402 biases the inner container 700 in the downward direction.

Further, the insert 412 is fixedly connected to a lower portion of the applicator head 200 in such a way that a lower portion of the product delivery passageway 212 is aligned with the conduit 408 of the pump assembly 400 forming a passage that allows the flow of the fluid product from the receptacle 404. The product delivery passageway 212 is aligned with the conduit 408 of the pump assembly 400 to form a single passageway 207 for carrying the fluid product from the inner container 700 to the applicator head 200.

A distal opening at the open distal end 502*a* of the housing 500 is enclosed by a lower end of the connecting collar 300. The inner surface of the connecting collar 3R) is connected to the outer surface at the distal end 502*a* of the housing 500 by snap fitment. It would not be outside the scope of present disclosure if the connecting collar 300 is connected to the housing 500 by a threaded engagement, a magnetic engagement, and the like.

The connecting collar 300 is connected to the applicator head 200 by a snap fitment. The lower portion 214 of the first applicator member 210 comprises at least one connecting groove 215 on its external surface which receives an internal protrusion 310 of the connecting collar 300 for snap-fitment, see FIG. 2 It would not be outside the scope of present disclosure if the connecting collar 300 is connected to the applicator head 200 by a threaded engagement, a magnetic engagement, and the like.

During use, the user applies pushing force on the button unit 800 pushes the inner container 700 in the upward direction in the housing 500 which in turn pushes the holder 410 and the receptacle 404 of the pump assembly 400 in the upward direction resulting in compression of the spring member 402 between the holder 410 and the insert 412 of the pump assembly 400. The compression of the spring member 402 towards the insert 412 causes the vacuum sealed member 416 to move in the upward direction and open an orifice 414 present in the conduit 408 of the pump assembly 400 resulting in the flow of fluid product from the receptacle 404 to the passageway of the conduit 408. Further, the fluid product flows from the co-axially aligned passageways of the conduit 408 of the pump assembly 400 and the product delivery passageway 212 of the applicator head 200.

As the push force from the button unit 800 is released, the inner container 700 moves in a downward direction, and the spring member 402 again expands creating a suction force that causes the check valve 406 to open and liquid product from the inner container 700 enters the receptacle 404 of the pump assembly 400 and simultaneously the piston 600 of the inner container 700 travels in the upward direction due to the force generated. The piston 600 displaces in the upward direction up to a certain height equivalent to balance the pressure created inside the inner container 700. The displacement of the piston 600 allows the movement of the fluid product towards the distal end 702*a* of the inner container 700. The fluid product now available in the receptacle 404 of the pump assembly 400 can be dispensed again through the applicator head 200 by pushing the button unit 800.

The fluid product released from the applicator head 200 can be applied to the skin of the user. The applicator head 200 applies the liquid product on the surface of the user's skin, lips, eyes, and the like.

In other alternate embodiments, the pump assembly 400 may be a dip tube assembly or any other assembly capable of sucking product from the inner container to the actuator.

In the present embodiment, a delivery mechanism for dispensing a fluid product is an airless pump with a replaceable inner container. In other implementations, any type of airless pump may be employed. However, in yet other implementations, any suitable delivery mechanism may be used.

The following is a discussion of examples, without limitation, of delivery mechanisms for dispensing a fluid product. The first example may be implemented using a click or a reverse click operation, whereby the user may operate the cosmetic dispensing package 1000 by moving the applicator head 200 relative to the housing in either a clockwise or counter-clockwise direction.

Another example delivery mechanism for dispensing the fluid product maybe a squeeze operation. In certain embodiments wherein the delivery mechanism is a squeeze operation, when pressure is applied to a housing such as a tube containing the fluid product, the fluid product in the tube may be forced, by the squeezing action, through the applicator head 200 via a product delivery passageway 212 for application to the users skin.

In yet another example, a delivery mechanism for dispensing the fluid product may be by a pressurized dispenser, such as an aerosol dispenser. In certain embodiments wherein the delivery mechanism is an aerosol delivery mechanism, the composition will be held under pressure in a housing and will be dispersed along with an aerosol propellant in response to actuation by a user. Actuation may be by depressing, rotating, tilting, or otherwise manipulating the applicator head 200, pressing a button, and/or by any other suitable dispensing mechanism. Details of the construction and propellant of an aerosol dispenser are within the skill of one of ordinary skill in the art and will, therefore, not be described in detail herein.

According to an aspect of the present disclosure, the cosmetic dispensing package 1000 is of an elongated cylindrical configuration. However, in alternate embodiments, the cosmetic dispensing package 1000 may be of an elongated square, polygonal configuration, oval, triangular, heart, or any other configuration known in the art.

According to an embodiment, the housing 500, the inner container 700 and the cap 100 may be made of a rigid material like glass, metal, hard plastic, a biodegradable material, or any other material known in the art. However, in alternate embodiments, the housing 500 and the cap 100 may be made of a flexible material like flexible polymeric material or any other material known in the art.

It will be understood that the foregoing is only illustrative of the principles of the disclosure, and that various modifications can be made by those skilled in the art without departing from the scope and spirit of the disclosure. For example, the shapes and/or sizes of various components can be different from the shapes and sizes shown herein. As another example, the materials used for various components can be different from those mentioned specifically herein.

What is claimed is:

1. An applicator head for a cosmetic dispensing package, the applicator head comprising:

a first applicator member;

a second applicator member coupled to one side of the first applicator member;

an applicator surface adapted to apply and dispense a fluid product;

wherein an upper surface of the applicator head defines the applicator surface;

wherein an upper surface of the first applicator member together with an upper surface of the second applicator member defines the applicator surface;

wherein the second applicator member is made of a thermal material capable of holding and retaining a thermal charge;

wherein the applicator surface is convex and angled;

wherein a recessed concavity is formed on the applicator surface;

wherein the upper surface of the first applicator member and the upper surface of the second applicator member meet at an interface defined on the applicator surface;

wherein a first portion of the recessed concavity lies on the first applicator member and a second portion of the recessed concavity lies on the second applicator member;

wherein when the first applicator member couples to the second applicator member, the first portion of the recessed concavity and the second portion of the recessed concavity align to complete the recessed concavity;

wherein a product delivery passageway extends through the first applicator member and terminates at a discharge opening in the first portion of the recessed concavity on the applicator surface; and wherein the recessed concavity forms a receptacle to collect a fluid product dispensed out from the discharge opening.

2. The applicator head according to claim 1, wherein at least a portion of the interface of the first applicator member and the second applicator member lies in the recessed concavity on the applicator surface.

3. The applicator head according to claim 2, wherein the discharge opening lies in the recessed concavity on the first applicator member such that the discharge opening is away from the interface.

4. The applicator head according to claim 1, wherein the applicator surface and the recessed concavity both are angled with respect to a longitudinal axis of the applicator head; wherein the applicator surface has a longitudinal axis that is inclined relative to the longitudinal axis of the applicator head and makes an angle of between 55-70° with the longitudinal axis of the applicator head.

5. The applicator head according to claim 4, wherein the applicator head has a generally elongated shape symmetrical with respect to a median longitudinal plane containing longitudinal axes of the applicator head and the applicator surface.

6. The applicator head according to claim 1, wherein the recessed concavity extends over more than a quarter of a width of the applicator surface as well as over more than a quarter of a length of the applicator surface; wherein a maximum width of the recessed concavity, measured perpendicular to a longitudinal axis of the applicator surface, is between 3 mm and 6 mm; wherein a maximum length of the recessed concavity, measured along the longitudinal axis of the applicator surface, is between 6 mm and 8 mm.

7. The applicator head according to claim 6, wherein a maximum width of the applicator surface, measured perpendicular to the longitudinal axis of the applicator surface is between 8 mm and 12 mm; wherein the length of the applicator surface, measured along the longitudinal axis of the applicator surface, is between 11 mm and 15 mm.

8. The applicator head according to claim 1, wherein the recessed concavity has a maximum depth, measured along a median longitudinal plane containing a longitudinal axis of the applicator head, is between 0.5 mm to 1 mm.

9. The applicator head according to claim 8, wherein the recessed concavity has the maximum depth defined at the interface; and wherein the product dispensed out from the discharge opening gravitates towards the interface and comes in contact with the thermal material of the second applicator member.

10. The applicator head according to claim 1, wherein the recessed concavity on the applicator surface is elongated along a longitudinal axis of the applicator surface and has an elliptical shape; and wherein the applicator surface has an elliptical shape.

11. The applicator head according to claim 1, wherein the upper surface of the second applicator member constitutes at least about 60% of the applicator surface and the upper surface of the first applicator member constitutes at least about 20% of the applicator surface.

12. The applicator head according to claim 1, wherein the first applicator member comprises a lower portion and an upper portion; wherein the lower portion includes at least one connecting feature on its external surface configured to be connected to a housing of the cosmetic dispensing package; wherein the upper portion of the first applicator member gradually tapers asymmetrically from a proximal end to a distal end portion thereof such that the upper portion of the first applicator member is off-centered with respect to the longitudinal axis of the applicator head.

13. The applicator head according to claim 12, wherein the upper portion of the first applicator member includes at least one sidewall that depends downward from the upper surface of the first applicator member; wherein the at least one sidewall includes a front sidewall, a left sidewall, a right sidewall, and a rear sidewall opposite to the front sidewall; wherein the front sidewall further includes at least two coupling protrusions that are spaced apart axially on the front sidewall.

14. The applicator head according to claim 12, wherein a lower portion of the product delivery passageway extending through the lower portion of the first applicator member is parallel to a longitudinal axis of the applicator head, and an upper portion of the product delivery passageway extending through the upper portion of the first applicator member is non-parallel and inclined with respect to the longitudinal axis of the applicator head; wherein the upper portion of the product delivery passageway has a narrower width than a width of the lower portion of the product delivery passageway.

15. The applicator head according to claim 1, wherein the second applicator member comprises a peripheral wall that depends downward from the upper surface of the second applicator member; wherein the peripheral wall of the second applicator member is open on one side; wherein the peripheral wall includes a left sidewall, a front sidewall, and a right sidewall; wherein the second applicator member includes at least two coupling grooves that protrude transversely to a longitudinal axis of the applicator head from an inner surface of the front side wall towards a rear opening of the second applicator member.

16. The applicator head according to claim 15, wherein each of the left and right sidewalls of the second applicator member is generally triangular that becomes narrower downward.

17. The applicator head according to claim 1, wherein the material of the second applicator member is selected from a group consisting of metals, metal alloys, stones, ceramics, and composites; and wherein the first applicator member is made of plastic, silicon, or ceramic material.

18. An applicator head intended to be associated with a cosmetic dispensing package such as a pump, a valve, or a flexible tube, the applicator head comprising:

a first applicator member;

a second applicator member coupled to the first applicator member at a sidewall of the first applicator member;

an applicator surface adapted to apply and dispense the fluid product;

wherein an upper surface of the applicator head defines the applicator surface;

wherein at least a portion of the first applicator member and at least a portion of the second applicator member defines the applicator surface;

wherein the second applicator member is made of a thermal material capable of holding and retaining a thermal charge;

wherein the applicator surface is convex;

wherein a recessed concavity is formed on the applicator surface;

wherein the applicator surface and the recessed concavity are inclined with respect to a longitudinal axis of the applicator head;

wherein the recessed concavity is partially made of the first applicator member and partially made of the second applicator member;

wherein when an upper portion of the recessed concavity is formed by the first applicator member and a lower portion of the recessed concavity is formed by the second applicator member;

wherein a product delivery passageway extends through the first applicator member and terminates at a discharge opening in the upper portion of the recessed concavity on the applicator surface;

wherein the recessed concavity extends over more than a quarter of a width of the applicator surface as well as over more than a quarter of a length of the applicator surface;

wherein the recessed concavity is farther from a proximal end of the applicator surface and is close to a distal end of the applicator surface; and wherein the recessed concavity forms a receptacle to collect a fluid product dispensed out from the discharge opening.

19. An applicator head intended to be associated with a cosmetic dispensing package such as a pump, a valve, or a flexible tube, the applicator head comprising:

a first applicator member;

a second applicator member coupled to the first applicator member at a sidewall of the first applicator member;

an applicator surface is defined by an upper surface of the applicator head;

wherein the applicator surface is partially defined by the first applicator member and partially by the second applicator member;

wherein the second applicator member is made of a thermal material capable of holding and retaining a thermal charge;

wherein the applicator surface is convex;

wherein a recessed concavity formed on the applicator surface;

wherein the applicator surface and the recessed concavity is inclined with respect to a longitudinal axis of the applicator head;

wherein the recessed concavity is partially made of the first applicator member and partially made of the second applicator member;

wherein an upper portion of the recessed concavity is formed by the first applicator member and a lower portion of the recessed concavity is formed by the second applicator member;

wherein a product delivery passageway extends through the first applicator member and terminates at a discharge opening in the upper portion of the recessed concavity on the applicator surface; and wherein the recessed concavity creates a receptacle on the applicator surface where a fluid product dispensed out from the discharge opening is collected.

20. The applicator head according to claim 19, wherein a sidewall of one of the first and second applicator members includes at least two coupling protrusions; wherein a sidewall of other of the first and second applicator members includes at least two coupling grooves; wherein at least two coupling protrusions are received in the at least two coupling grooves.

* * * * *